United States Patent [19]

Huffman

[11] Patent Number: 4,505,431

[45] Date of Patent: Mar. 19, 1985

[54] APPARATUS FOR DISCHARGING THREE COMMINGLED FLUIDS

[75] Inventor: David C. Huffman, Wilton, N.H.

[73] Assignee: Spraco, Inc., Nashua, N.H.

[21] Appl. No.: 388,228

[22] Filed: Jun. 14, 1982

[51] Int. Cl.[3] : ..... B05B 7/04

[52] U.S. Cl. ..... 239/428; 239/427.5; 239/434

[58] Field of Search ..... 239/396, 416.1, 427.5, 239/428, 433, 434; 169/15

[56] References Cited

U.S. PATENT DOCUMENTS

| | | | |
|---|---|---|---|
| 736,664 | 8/1903 | Williams | 239/428 |
| 1,394,377 | 10/1921 | Vallely | 239/427.5 |
| 1,687,105 | 10/1928 | Naab | 239/427.5 |
| 2,107,340 | 2/1938 | Pedrick | 239/427.5 |
| 2,176,682 | 10/1939 | Pedrick | 239/427.5 |
| 2,198,585 | 4/1940 | Urquhart | 169/15 |
| 2,391,422 | 12/1945 | Jackson | 239/427.5 |
| 2,630,183 | 3/1953 | Foutz | 239/427.5 |
| 3,073,534 | 1/1963 | Hampshire | 239/428 |
| 3,430,865 | 3/1969 | McDougall | 239/427.5 |

*Primary Examiner*—Andres Kashnikow
*Assistant Examiner*—James R. Moon, Jr.
*Attorney, Agent, or Firm*—Charles Hieken

[57] ABSTRACT

Apparatus in which water and liquid detergent meet in a venturi chamber to be commingled there, the detergent being drawn into the venturi by the condition of unbalanced (lowered) pressure there resulting from the velocity of the water flowing through the venturi throat. Compressed air is introduced into a nozzle in communication with the venturi, and the commingled water, detergent, and air are then discharged for use in the form of a foam. The water inlet includes a removable insert separate from the venturi, the upstream end of the insert being exposed for direct accessibility for a mounting tool, and an annular chamber located upstream from the discharge end of the venturi outlet initially receives the compressed air which is then caused to be discharged in an annular condition about the commingled detergent and water flow.

5 Claims, 6 Drawing Figures

APPARATUS FOR DISCHARGING THREE COMMINGLED FLUIDS

BACKGROUND OF THE INVENTION

FIELD OF THE INVENTION

The present invention relates to fluid discharging apparatus having means for a plurality of fluids to commingle upstream of the terminus, and more particularly to apparatus having three areas along a flow path, a separately supplied fluid being added to the fluid in said flow path at each area, and the fluids each differing from the others in some essential characteristic such as state, pressure, composition, etc.

BACKGROUND

Such apparatus may employ a variety of fluids depending upon the purposes of their use. Several prior art U.S. Letters Patent examples of fluid combinations for such purposes are:

(A) Gas, air, and oil-steam mixture for heating: Vallely, U.S. Pat. No. 1,394,377, Oct. 18, 1921;

(B) Oil, steam, and air for heating: Scherding, Ser. No. 783,898, Feb. 28, 1905 and Jackson, U.S. Pat. No. 2,391,422, Dec. 25, 1945;

(C) Oil, hot air, and cold air for heating: Naab, U.S. Pat. No. 1,687,105, Oct. 9, 1928;

(D) Water, detergent, and air for cleaning: McDougall, U.S. Pat. No. 3,430,865, Mar. 4, 1969;

(E) A gas which does not support combustion, detergent, and water for fire extinguishing: Foutz, U.S. Pat. No. 2,630,183, Mar. 3, 1953;

(F) Truck engine exhaust gas, "foam-forming material", and water for fire extinguishing: Urquhart, U.S. Pat. No. 2,198,585, Apr. 23, 1940; and (G) Steam, solvent, and water for washing: Pedrick U.S. Pat. Nos. 2,107,340, Feb. 8, 1938, and 2,176,682, Oct. 17, 1939.

BRIEF SUMMARY OF THE INVENTION

The present invention relates to apparatus for discharging three fluid constituents in a commingled condition, and while the main constituent may be a combustible oil as for heating, or a vegetable oil as for pan greasing, for purposes of exposition here the embodiment illustrated is to be used for creating a washing foam made up of water, air, and a liquid other than water such as a foam-forming detergent which expression is intended to include in meaning an equivalent liquid soap or a solvent.

The invention contemplates the provision of apparatus employing an inlet for water under pressure, a venturi for causing the induction of detergent into the apparatus under the influence of the water flow, and the introduction of compressed air into the apparatus to atomize and commingle with the water-detergent mixture and effect its ultimate discharge from the apparatus in the form of foam. The invention further contemplates that the water initially enter an interchangeable inlet element removably mounted with its upstream end exposed for direct accessibility for a mounting tool, thereby eliminating the necessity for disassembling a plurality of parts for each interchange, and the invention further contemplates that the atomizing air be introduced to the water-detergent mixture in an annular and surrounding condition as opposed to a jet hitting the center or core of such a mixture flowing within a passage.

DETAILED DESCRIPTION OF THE PREFERRED EMBODIMENT OF THE PRESENT INVENTION

Figure 4:
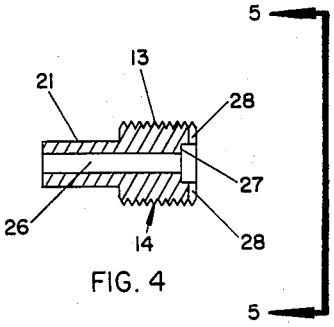
FIG. 4 is a view in sectional elevation of the insert received by the body.

Referring to the drawing, the preferred embodiment of the present invention is there illustrated as provided with a body member 10 (FIGS. 1–3 and 6) which may, if desired, be made of hex stock and is provided at one end with a fluid inlet 11 which has an internally threaded passage 12 to receive the threaded portion 13 of an insert 14 (FIGS. 1 and 4) more fully described infra. The inlet 11 is adapted for connection to a suitable source of water under pressure (not shown).

On its opposite end the body 10 is provided with a cylindrical boss 15 on which is preferably press-fitted the cylindrical upstream end portion 16 of a nozzle 17 (FIG. 1) having an internal passage 18 circular in cross section terminating in an internally flaring outlet portion 19 as a discharge terminus.

Following downstream from the threaded body inlet passage 12 is a passage 20 (FIGS. 1–3) of reduced diameter for receiving the unthreaded end portion 21 of the insert 14 (FIGS. 1–2 and 4), and the passage 20 leads downstream to a venturi consisting of an inlet chamber 22, a throat 23 of reduced diameter, and a discharge passage, i.e., outlet portion, 24 terminating in a boss extension 25 circular in cross section and extending axially into the interior of the nozzle passage 18 in laterally spaced relation thereto by reason of the diameter of the boss extension 25 being smaller than the diameter of the nozzle passage 18.

Figure 5:
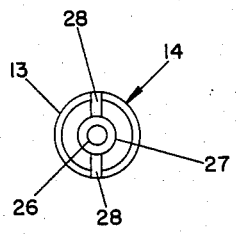
FIG. 5 is a view in elevation taken along the line 5—5 of FIG. 4.
Figure 6:
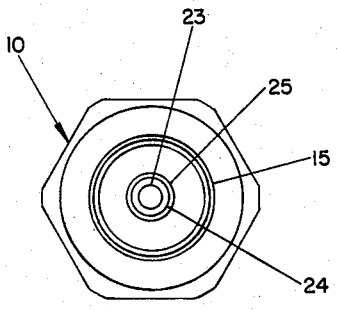
FIG. 6 is a detail view in elevation taken along the line 6—6 of FIG. 3.
Figure 3:
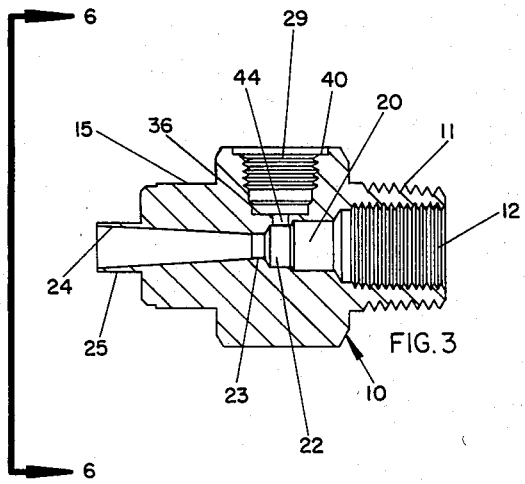
FIG. 3 is a detail view in sectional elevation, similar to FIG. 2 but showing the complete internal body passage for receiving the insert.
Figure 2:
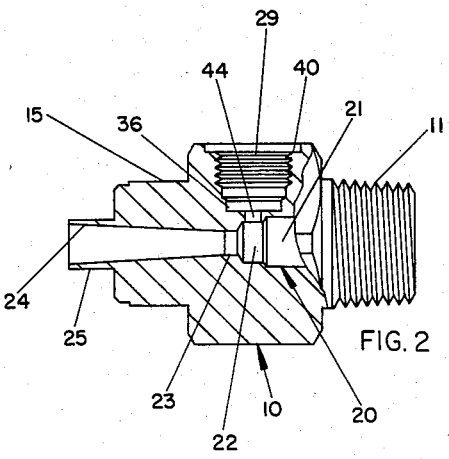
FIG. 2 is a detail view in elevation, chiefly in section, of the body itself, with the exposed part of the insert and the water inlet end portion being shown in full line.
Figure 1:
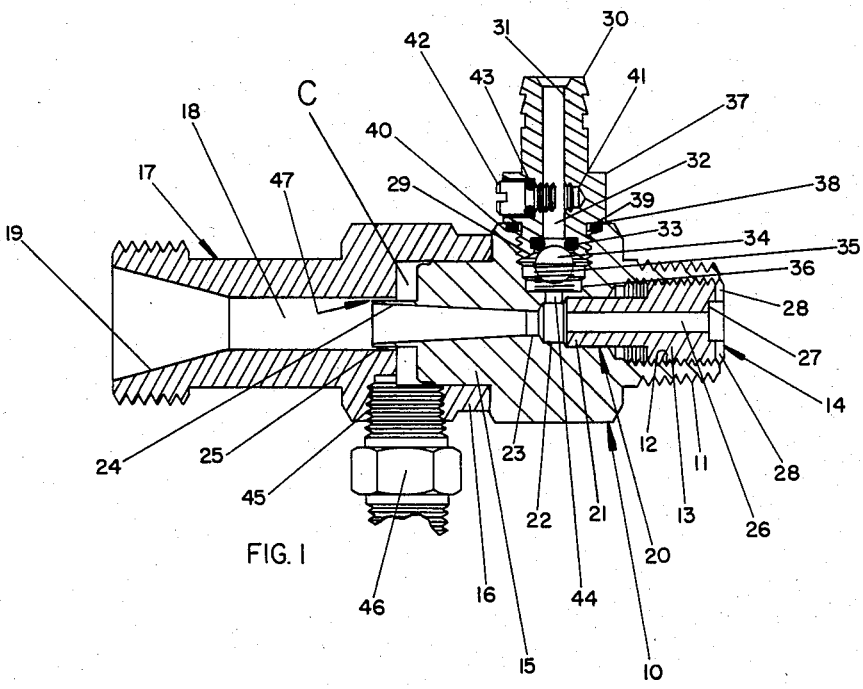
FIG. 1 is a view in elevation, chiefly in section, of the preferred embodiment of the present invention.

Referring particularly to FIGS. 4 and 5, the insert 14 is provided with an axial through passage 26, and has a counterbore 27 at its upstream end (when considered as mounted in the body passage 12 as in FIG. 1), this counterbore 27 leading to the passage 26 and having a diameter greater than that of the passage 26. Depressions 28 are located diametrically in the counterbored end of the insert 14 for the reception of a tool such as a screwdriver for removably mounting the insert 14 in the body passage 12, and as shown in FIGS. 1 and 4 the depressions 28 have a depth less than that of the counterbore 27, thereby insuring that in use a mounting tool can not touch the upstream end of the passage 26 and distort it. As shown in FIGS. 1–2, the insert unthreaded portion 21 seats at the entrance to the venturi inlet chamber 22.

In practicing the present invention it is contemplated that interchangeable inserts 14 with differently diametered through passages 26 be provided, so that the flow rates of fluid to the venturi 22-23-24 and nozzle passage 18 may be varied for a given water pressure and/or application selected for the apparatus as a whole. To facilitate this interchangeability the upsteam end of the insert 14 is exposed as shown in FIG. 1 and is not concealed by other structure with the result that there is thereby provided direct accessibility for a mounting tool to the depressions 28 as compared to the necessity for disassembling several parts to get at what is a completely internal and covered element.

Referring again to FIG. 1, it will be seen that considering as a whole the embodiment there illustrated, the insert passage 26, the venturi chamber 22, throat 23, and outlet portion 24, the nozzle internal passage 18 and the interior of the outlet portion 19 constitute together an axial passage for the flow through the nozzle 17 of water introduced into the body inlet 11.

In order to introduce into the structure so far described a liquid fluid other than water, i.e., a foam-forming detergent, to be commingled with the water from the inlet 11, the body 10 is provided at its upper portion (viewing FIGS. 1-3) with a threaded passage 29, which receives the lower end of an inlet comprising a nipple 30 adapted to be connected to a source (not shown) of a foam-forming liquid detergent. The nipple 30 has a through passage 31 terminating downwardly in a seat 32 for an O-ring 33 against which a check-valve ball 34 is yieldingly pressed by a coil spring 35 which rests in a seat 36 formed in the body 10. The nipple 30 has a circumferentially enlarged portion 37 which provides a shoulder 38 engaging an O-ring 39 located in a seat 40 (FIGS. 1-3) formed in the body 10 to act as a fluid seal, and a threaded passage 41 formed in the nipple 30 transversely across its enlarged portion 37 receives a screw 42 for varying the amount of detergent which may flow through the passage 31, thereby to vary and regulate the proportion of detergent-to-water for given applications. The screw 42 engages an O-ring 43 seated in the nipple enlarged portion 37. Communication between the nipple passage 31 and the venturi inlet chamber 22 when the ball 34 is unseated is afforded by a passage 44 (FIGS. 1-3) leading directly and immediately to the venturi inlet chamber 22, whereby detergent from the nipple 30 and water from the insert passage 26 commingle in the venturi inlet chamber 22.

In order to introduce compressed air into the body 10 to commingle with the water from the body inlet 11 and the detergent from the nipple 30 and complete their discharge from the nozzle 17 as foam, the nozzle is provided at its under side (viewing FIG. 1) with a threaded inlet 45 which receives a nipple 46 adapted for connection with a source of air under pressure (not shown) having the usual pressure regulating valve and gauge.

As brought out in FIG. 1, the depth of the nozzle upstream end portion 16 is greater than the length of the main body of the boss 15 with the result that there is formed within the nozzle 17 an annular chamber C downstream of the main body of the boss 15. The chamber C, as shown in FIG. 1, is located between the discharge passage portion of the nozzle 17 and the portion of the body (boss 15) from which the venturi outlet portion 24 extends and intersects the air inlet passage 45 so as to receive air under pressure from the nipple 46. Completing the structure the boss extension 25 extends downstream into the interior of the nozzle discharge passage 18, as shown in FIG. 1, terminating downstream beyond the chamber C, i.e., beyond the area of air admission to the passage 18, and since the extension 25 has an outside diameter smaller than that of the nozzle passage 18, as shown, there is created an annular passage 47 through which air is discharged in an annular condition and then is commingled within the nozzle passage 18 with the two already commingled fluids, water and detergent, from the venturi outlet portion 24.

In using the preferred embodiment of the present invention a hose (not shown) provided with a suitable discharge element is attached to the discharge end of the nozzle 17 and the detergent is preferably stored in some suitable container under only atomospheric pressure, a conduit (not shown) leading from this container to the nipple 30. A suitable conduit (not shown) leads from a source of water under pressure and is readily removably secured to the body inlet 11, and with the water turned on its velocity of flow from the venturi inlet chamber 22 through the venturi throat 23 causes at the throat 23 a partial vacuum, i.e., a condition of unbalanced or lowered pressure with respect to the pressure of the atmosphere on the stored detergent, and as a result detergent is drawn through the nipple 30 and body passage 44 into the venturi inlet chamber 22 where the detergent is commingled with the water there, this two-fluid mixture then flowing through the venturi throat 23 and discharge passage 24 and into the nozzle internal passage 18. The coil spring 35 which, with the ball 34, performs no checking function when the apparatus is discharging foam, yields to the pressure of the flowing detergent, as is well understood in the operation of spring-pressed check valves, to permit the flow of detergents to the venturi inlet chamber 22 for commingling with the water there.

Compressed air from a suitable source (not shown) is then introduced into the nipple 46 for entrance into the annular chamber C (FIG. 1), and from there the air flows through the annular passage 47 which surrounds the boss extension 25. The partial vacuum thus created within the nozzle passage 18, i.e., the condition of unbalanced pressure with the nozzle passage 18 at the end of the venturi discharge passage 24, results in the commingled detergent and water as a mixture being subject to air induced flowing through the nozzle passage 18. It will be appreciated also that commencing at the end of the venturi discharge passage 24 the compressed air flowing from the annular passage 47 surrounds and expands to agitate and commingle with the flowing detergent and water mixture, with the result that the commingled detergent and water are more efficiently atomized into a foam at the point of discharge from the nozzle 17 than would be the case if an air jet were directed centrally into the core of a detergent-water mixture in the nozzle passage 18.

Recommended pressure ranges for the water and compressed air vary between 30 and 80 psi for the water and 20 and 60 or higher psi for the air. With water at 40 psi and the air at 20 or 30 psi, a medium or moist foam is produced, the droplets being relatively large, while water at 40 psi and air at 60 psi or higher give a dry foam as it is more aerated, causing the droplets to be smaller.

In a given embodiment of the present invention it is preferred that the downstream end of the insert 14, i.e., the end of the insert unthreaded portion 21, terminate substantially at the passage 44 for the admission of detergent into the venturi inlet chamber 22, as shown in FIGS. 1 and 2, the reason being that this gives the maximum unbalanced pressure condition for inducing flow of detergent through the passage 44. If the end of the insert unthreaded portion 21 terminates appreciably upstream from the passage 44 the unbalanced pressure condition created is lessened in extent, and (viewing FIG. 1) if the end of the insert unthreaded portion 21 underlies the passage 44 to any extent the effective size of the venturi inlet chamber 22 is reduced with a consequent diminution of efficiency.

What is claimed as new is:

1. In apparatus for discharging three commingled fluids separately supplied characterized by i. a body provided with a venturi having an inlet chamber for receiving water under pressure, an outlet portion, and a throat between the inlet chamber and the outlet portion;

ii. the body also being provided with an inlet adapted to receive a liquid other than water and having a through passage the discharge end of which is in direct and immediate communication with the venturi inlet chamber;

iii. a nozzle mounted on the body and having means defining a nozzle discharge passage in communication with the venturi outlet portion; and iv. means for the admission of air under pressure into the nozzle for discharge therefrom through said nozzle discharge passage into the atmosphere; the improvement which consists of A. an insert separate from the venturi mounted in the body and having a through passage for receiving water under pressure and also having a discharge end portion terminating downstream substantially at the passage for the discharge of said fluid other than water directly and immediately into said venturi inlet chamber; and B. the downstream end of the venturi outlet portion being of reduced size extending into the nozzle discharge passage to define an annular gap for air admission between said venturi outlet portion downstream end and said means defining a nozzle discharge passage and terminating downstream beyond and near the area of air admission to the nozzle discharge passage which area is closer to said downstream end than to the upstream end of said venturi outlet portion.

2. Structure as described in claim 1 characterized by the fact that there is a chamber between the discharge passage portion of the nozzle and the end of the portion of the body from which said venturi outlet portion extends, said chamber receiving the admitted air before its discharge from the nozzle after passing through said annular gap.

3. Structure as described in claims 1 or 2 characterized by the fact that the insert is removably mounted in the body with the upstream end of the insert exposed for direct accessibility for a mounting tool.

4. Structure as described in claims 1 or 2 characterized by the fact that the means for admission of air into the nozzle is carried by the nozzle.

5. Structure as described in claim 2 characterized by the fact that the air-receiving chamber is annular in shape.

* * * * *